United States Patent [19]

Windley

[11] Patent Number: 4,728,472

[45] Date of Patent: Mar. 1, 1988

[54] CELLULAR FIBERS VIA SOLUBLE FLUID INJECTION

[75] Inventor: William T. Windley, Seaford, Del.

[73] Assignee: E. I. Du Pont de Nemours and Company, Wilmington, Del.

[21] Appl. No.: 860,249

[22] Filed: May 6, 1986

[51] Int. Cl.[4] ..... D01F 1/02

[52] U.S. Cl. ..... 264/53; 264/211; 264/210.6; 264/210.8; 264/211.12; 521/60; 521/79; 521/98

[58] Field of Search ..... 264/54, 211, 211.12, 264/210.6, 210.8, 53; 521/917, 60, 79, 98, 142

[56] References Cited

U.S. PATENT DOCUMENTS

| | | | |
|---|---|---|---|
| 3,095,258 | 6/1963 | Scott | 18/54 |
| 3,214,234 | 10/1965 | Bottomley | 8/55 |
| 3,329,557 | 7/1967 | Magat et al. | 161/172 |
| 4,164,603 | 8/1979 | Siggel et al. | 428/398 |
| 4,380,594 | 4/1983 | Siggel et al. | 521/182 |
| 4,544,594 | 10/1985 | Li et al. | 428/92 |
| 4,562,022 | 12/1985 | Li et al. | 264/53 |

*Primary Examiner*—Jan H. Silbaugh
*Assistant Examiner*—Hubert C. Lorin

[57] ABSTRACT

A fiber having ½–50% substantially gas-filled and essentially all closed cells having a diameter of 0.2–25 microns and a length to diameter ratio of greater than 500 is disclosed. The fiber is made by mixing a fluorocarbon blowing agent into molten polymer, shearing the polymer at a high shear rate, extruding the polymer in a spinneret capillary at a low jet velocity and a low capillary entrance pressure and drawing down the polymer at a total extension greater than 1000.

14 Claims, 9 Drawing Figures

CELLULAR FIBERS VIA SOLUBLE FLUID INJECTION

DESCRIPTION

Technical Field

This invention relates generally to cellular fiber products and more particularly it relates to fibers having substantially gas-filled closed cells of defined size and the process for making such fiber.

BACKGROUND

Foamed polymeric products have been made by dispersing or dissolving various materials known as blowing agents into molten polymer. Examples of such blowing agents are air, nitrogen or other gasses, volatile materials which are gaseous at molten polymer temperatures such as hydrocarbons or methylene chloride, and materials which decompose to form gaseous products. The products range from high-void material with polyhedral cells which may be ruptured (open cell foam) to low-void closed-cell material having elongated voids. Siggel et al U.S. Pat. Nos. 4,164,603 and 4,380,594 disclose polymeric filaments having random voids made by injecting dimethylsiloxane nucleating agents (silicone oil) of viscosity 3–400 cp at a rate of 0.1 to 1.0 percent and up to 10 percent of soluble gas or gas forming agent inert to the melt which was then extruded through spinneret capillaries at unusually high jet velocities of 5900 cm/min. or more to form filaments having the desired cavities. Siggel also discloses fluorohydrocarbon as a possible gas forming agent.

Yarns produced from polymers containing blowing agents were described by Scott U.S. Pat. No. 3,095,285 but these yarns were produced from plugged capillaries and had continuous hollow voids that enlarged due to the gas expansion inside the filament during extrusion and quenching. No random voids were disclosed.

Randomelongated voids have also been made in polymeric textile filaments by dispersing polyethylene oxide in the molten polymer, extruding the mixture into filaments and drawing the filaments to give elongated striations of PEO within the polymer. When the filaments are made into fabric and scoured as in Magat & Tanner U.S. Pat. No. 3,329,557 or dyed, a portion of the water-soluble PEO is extracted, leaving at least partial voids. These voids reflect incident light and obstruct transmitted light, giving desirable luster and soil-hiding. However, the degree of PEO extraction depends on the degree of scouring of the fabric, the size of the filament, the molecular weight of the PEO, etc., so that the yarn luster can be quite variable and unpredictable. The cost of the PEO can add considerably to the cost of the product. Furthermore, a filament having, for example, 4% PEO may have 10% lower tenacity than the same filament without PEO.

A fiber having substantially gas-filled closed cells of defined size over a wide range of percent cell content would be greatly desired. Higher strength is usually desired, or at least avoidance of strength loss.

SUMMARY OF THE INVENTION

The fiber of the present invention is characterized by substantially gas-filled cell content of ½–50% by volume, essentially all of the cells being closed, being of 0.2–25 microns in diameter and having a length to diameter ratio of greater than 500, preferably greater than 2000. The fiber is further characterized by a plurality of the cells having a diameter of greater than one-twentieth the effective diameter of the fiber, a detectable level of fluorocarbon in the fiber and greater than 3 cells per fiber. For polyamides the fluorocarbon is from the group comprising dichlorotetrafluoroethane (FC-114), monochloropentafluoroethane (FC-115) and dichlorodifluoromethane (FC-12).

The process of the present invention for making a fiber with cells comprises the steps of:

(a) mixing a fluorocarbon blowing agent into molten polymer and shearing the molten polymer at greater than about 8,000 reciprocal seconds;

(b) extruding the polymer through a spinneret capillary at a jet velocity less than about 150 cm/min. and a differential capillary pressure of less than 0.5 kg/cm$^2$, preferably less than 0.1 kg/cm$^2$; and (c) drawing down the polymer at a total extension of greater than 1000. The molten polymer is preferably polyamide, polyester, or polypropylene. The amount of fluorocarbon blowing agent injected into the molten polymer is preferably less than 2% and for polyamides preferably less than 0.5%. The shearing of greater than 8000 reciprocal seconds is preferably provided by a pump. The molten polymer is extruded through a counterbore at a jet velocity of less than 50 cm/min.

The random cells of the present invention hide soil on carpet fibers by scattering light back to the viewer, preventing soil on the opposite side of the filament from being seen through the polymer. They also provide delustering without the drawbacks of particulate matter such as titanium dioxide which can give a chalky appearance and accelerate degradation of the polymer from ultraviolet light. The cells also reduce the density and increase the covering power of the filaments to hide the backing of a carpet more effectively, also contributing higher bulk. Compared to cells made by polyethylene oxide striations, the gas-filled cells of the present invention do not require extraction of PEO to produce the cells, and there is no problem of partial extraction.

When a preferred fluorocarbon is used as cell-forming agent, the detriments of decomposing agents, such as yellowing of the filaments, are avoided. Only very small amounts of preferred fluorocarbon blowing agents are required to form cells, particularly when they are used in conjunction with preferred levels of shear in the polymer. Furthermore, the fluorocarbons inhibit the formation of spherulites which can erratically deluster nylon 66 polymer and reduce filament strength, particularly when operating at high shear rates to promote cell formation.

In the present invention the amount of gas forming agent required is reduced by 100 to 1000× due to the surprisingly efficient expansion of the blowing agent as pressure is reduced in enlarged capillaries. The quality of the fiber is also superior due to the increased purity of the polymer which contains no oil. The cells when formed initially contain fluorocarbon in the gaseous state and as the fluorocarbon diffuses out it is replaced by air. The process of the present invention does not require a nucleating agent, although in some instances nucleating agents may add benefits.

In foamed filaments, particularly those which exceed 50% cells, the expansion of the blowing agent in cells near the outer surface of the filament and low degree of stretching imposed on the filament during and after extrusion produce nearly spherical or only slightly elongated cells which protrude from the surface or erupt to form open cells. The fiber of the present invention has closed cells of high length to diameter ratio. The fiber thus has a smooth surface or a surface that is substantially free from protrusions in the surface caused by ruptured cells. Thus, cells do not trap soil or disrupt the reflectance of the filament surface which is a major factor determining luster.

Conventional foam filaments have traditionally had substantially round cross section except for the departures from a true circle caused by protruding cells. Making non-round filaments of controlled cross-sectional shape, such as trilobal, is difficult. The present process using a substantial degree of drawdown from the spinneret and/or a substantial cold drawing after extrusion permits making non-round shapes of controlled cross-section. The drawdown and cold drawing also gives the filaments a tenacity in the range necessary for adequate performance in carpets.

BRIEF DESCRIPTION OF DRAWINGS

FIG. 7(*b*) is a schematic drawing of the shape of the polymer as it exits a foam-forming spinneret.

FIG. 7(*c*) is a schematic drawing of the shape of the polymer of this invention as it exits the spinneret.

DETAILED DESCRIPTION OF THE DRAWINGS

Figure 1:
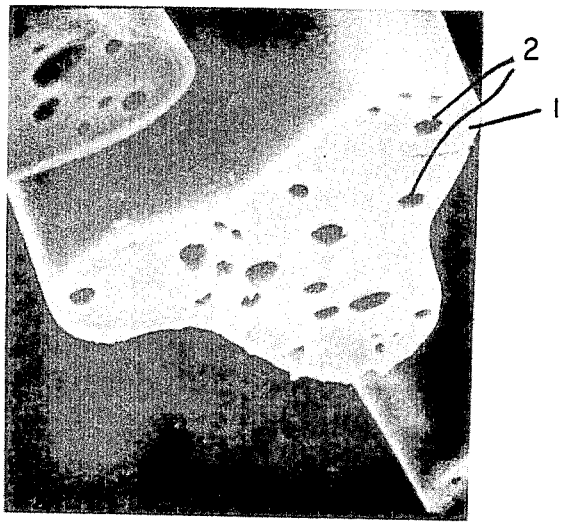
FIG. 1 is a perspective view of the cut end of a fiber of the present invention.

Referring to FIG. 1, a trilobal fiber 1 of the invention is seen to have substantially round cells 2 of different diameters scattered randomly throughout the cross section of the fiber.

Figure 2:
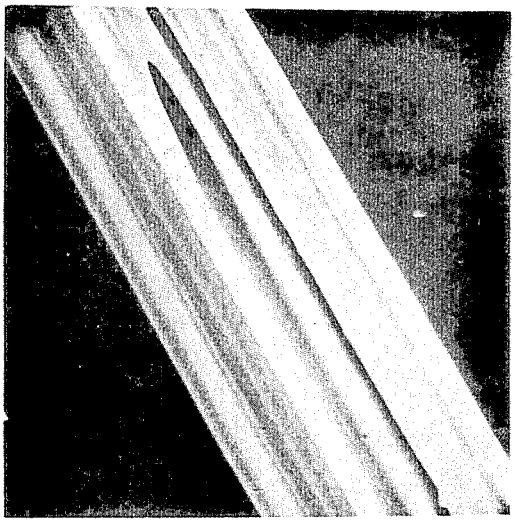
FIG. 2 is a longitudinal section of a similar fiber made by peeling off one side.

FIG. 2 is a longitudinal section of a fiber similar to FIG. 1 showing that the cells are elongated and discontinuous, the length of the cells depending on the degree of drawdown which the fiber receives as it is cooling and the degree of any subsequent cold drawing.

Figure 3:
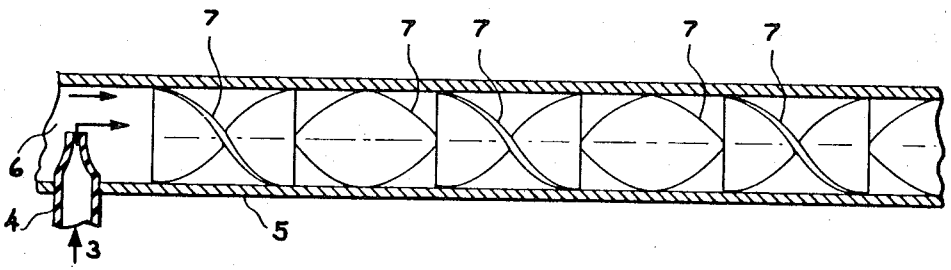
FIG. 3 is a schematic drawing of one method of injecting blowing agent into a molten polymer pipeline and mixing it into the polymer.

Referring to FIG. 3, a pump (not shown) capable of very accurate metering of very small flow rates at pressures higher than that of the polymer injects blowing agent 3 through nozzle 4 into the center of pipe 5 carrying molten polymer 6. The polymer and blowing agent enter one or more mixers 7 which may either be of the static type such as are made by Kenics, shown here, or powered mixers.

In polymers of high relative viscosity, about 50–75 RV or more, outgassing and bubble formation are inhibited under conventional extrusion conditions wherein the polymer remains under high pressure as it enters the spinneret capillary typically at a pressure of 1.4 to 15 $kg/cm^2$, moves at relatively high velocity through a small-diameter capillary, and is drawn rapidly away from the capillary exit.

It has been determined that fluorocarbon blowing agents dissolved in polyamide, polyester, and polypropylene polymers will not expand if the polymer pressure is greater than the pressure required to maintain the fluorocarbon in solution. This solubility pressure varies directly with concentration of fluorocarbon in the polymer and inversely with temperature except for polypropylene for which the pressure increases with temperature. Knowing these relationships it is possible to design enlarged spinneret capillaries having short lengths permitting pressure drops that are lower than the solubility pressure of the fluorocarbon dissolved in the polymer for any given temperature, melt viscosity, or throughput. It is further possible to specify the fluorocarbon concentration so that voids will expand either totally within the capillary, near the capillary exit where that pressure is reduced, or just outside the capillary where pressure is atmospheric and temperature is reduced.

For other than polypropylene, as the polymer leaves the spinneret and the temperature decreases, the polymer pressure decreases to zero and the fluorocarbon solubility pressure increases. These factors can help promote growth of cells within the filament. However, the melt viscosity increases until the fiber solidifies. At some point the melt viscosity reaches a point where no further cells can form.

The solubility of fluorocarbon in polyamide is greater at higher polymer temperature and therefore the solubility pressure is lower. It is advantageous to spin polyamide or polyester yarns of the invention at temperatures within about 30° C. of the polymer melting point to provide maximum vapor pressure for void formation. Polypropylene, on the other hand, shows an opposite behavior in that the solubility of fluorocarbon is less at higher temperatures and the solubility pressure is greater. Therefore, polypropylene yarns of the invention may advantageously be spun at polymer temperatures 50° C. or more above the melting point. It has been found for example that for Pro-Fax 6823 polypropylene the fluorocarbon solubility pressure is below atmospheric at 180° C. for a concentration of 0.66 percent FC-114. Pro-Fax has a melting point of about 160° C. The viscosity of polypropylene is lower at higher temperatures and therefore voids may be formed more easily at higher temperatures.

Figure 4:
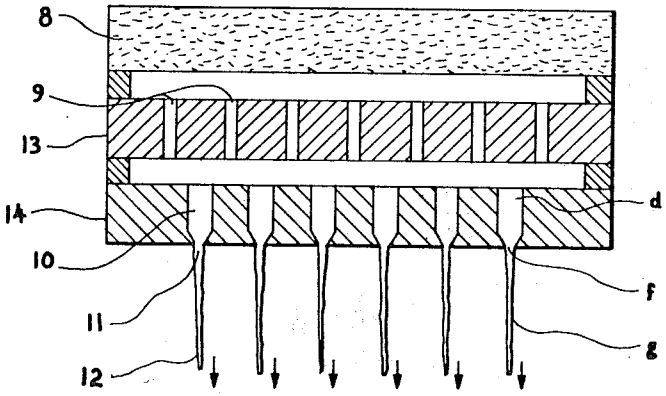
FIG. 4 is a schematic diagram of one type of spinning pack usable with the process of the invention.

In the present process, the polymer pressure is preferably lowered to a point at which bubbles can begin to form where the vapor pressure exceeds the polymer pressure and is maintained at or below such pressure for a period of time which allows bubbles to grow before the polymer emerges from the capillary and is drawn away to form filaments while cooling. One means of providing such conditions is shown in FIG. 4, wherein the polymer undergoes shear in filter medium 8 which helps to distribute the blowing agent uniformly throughout the polymer and aids bubble nucleation. Mixing and shear nucleation are also aided by the action of polymer meter pumps which are usually of the gear type. Higher pump speeds give greater shearing and mixing action. Such shear also gives decreased melt viscosity of the polymer which aid outgassing.

The shear also raises the temperature of the polymer and reduces its viscosity, which facilitates bubble growth. The polymer then passes through orifice 9 in plate 13 sized to provide a large pressure drop at the desired polymer throughput into chamber 10 of spinneret 14 having outlet 11 of larger diameter than conventional spinnerets.

The volume of chamber 10 may be sized to provide a desired hold-up time and pressure drop for bubble growth, and the diameter and length at outlet 11 may be sized to provide a desired hold-up time and pressure; larger diameters and shorter lengths giving lower pressure, and longer lengths of low-pressure ducts giving more growth.

Polymer containing bubbles then emerges from outlet 11 at low velocity and is drawn away to form filaments 12, the cells becoming highly elongated and reduced in diameter.

The cell length and L/D ratio of the product of this invention are high. By examining the fiber of Example 2 under an optical microscope, it was learned that many cells are greater than one inch (2.54 cm) in length. The cell diameter would be the same as the cell length before elongation begins. For a cell of diameter approximately 10 microns and a length exceeding 2.54 cm, the L/D ratio would be approximately 2500.

Another means of providing a desired hold-up time at low pressure is to use larger distribution (meter) plate capillaries above the spinneret. Also thicker spinnerets with longer counterbores and capillaries will increase hold-up time at low pressure. The need for hold-up time at low pressure must be balanced with the need for pre-shear above the capillary for bubble nucleation.

Since bubble formation is affected by the conditions referred to above, it is important that each filament be subjected to the same conditions in order that all filaments have the same cell character. For example, the polymer temperature near the edges of a spinneret is often lower than at the center due to heat loss. Various methods of insuring equal temperatures may be necessary.

Conversely, if different numbers or sizes of bubbles are desired in different filaments or in different portions of the same filaments, measures may be taken to produce the particular distribution. For example, if larger voids are desired at the periphery of a filament, the holdup chamber may be designed to have a much lower flow velocity and longer residence time at the periphery, allowing bubbles in this region more time to grow.

The large spinneret capillaries which are required to achieve low pressure and long holdup time also give the filaments a degree of differential orientation from one side of the filament to the other. This provides latent self-crimping force which add to the bulkiness imparted by mechanical or fluid jet crimping.

Figure 5:
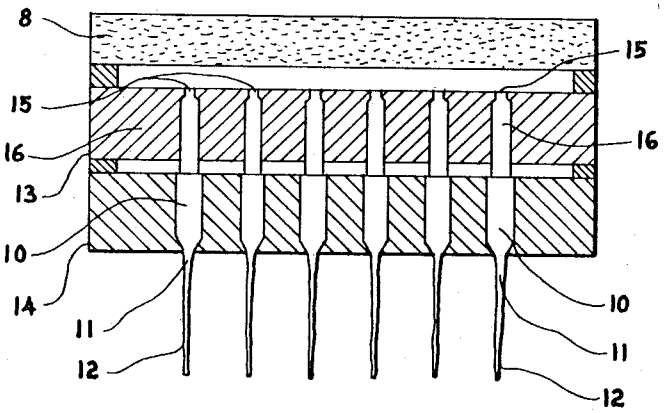
FIG. 5 is a schematic diagram of the type of spinning pack used with Example 7.

FIG. 5 is similar to FIG. 4 and represents the spinning pack configuration used in Example 7. FIG. 5 differs from FIG. 4 in that there is a pre-shearing capillary 15 of the distribution plate and that there is an extended counterbore 16 that connects with the existing counterbore in the spinneret. Note that the holes in the plate in FIG. 5, unlike in FIG. 4, are aligned with the holes in the spinneret allowing lengthening of the spinneret counterbore without the necessity of building a new spinneret.

Figure 6:
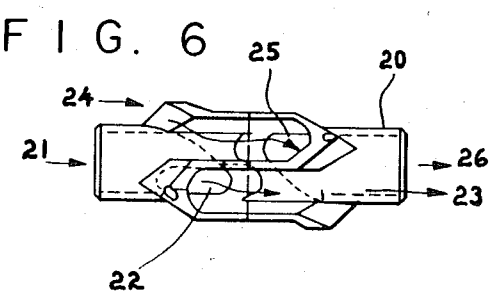
FIG. 6 is one type of flow inverter which may be used in a polymer pipeline.

Referring to FIG. 6, a flow inverter 20 may be inserted into the polymer transfer line and may be beneficial for increasing the thoroughness of mixing of blowing agent into polymer. In the inverter shown, polymer 21 flowing near the axis of the line emerges outwardly from three holes 22 equally spaced about the device and flows along the periphery 23 of the line while polymer approaching flow inverter 20 near the periphery flows inwardly through holes 25 and emerges near the axis 26. This device may be placed after a series of mixers 7 of FIG. 3 and may be followed by other mixers 7.

Products of the invention may be made from polyethylene terephthalate, polypropylene, nylon 66 and nylon 6. Copolymers of nylon 66 and 6 are particularly suitable because of the greater solubility of the preferred fluorocarbons in such copolymers. A copolymer containing about 4% nylon 6 is particularly useful, having a lower melting point, less degradation, less gel propensity and a higher dye rate than nylon 66.

Preferred blowing agents for use in polyester and nylon 66 are dichlorotetrafluoroethane (F-114), boiling point 3.8° C. at atmospheric pressure, and monochloropentafluoroethane (F-115), boiling point −38.7° C. or dichlorodifluoromethane (F-12), boiling point −29.8° C., with stabilizer because they do not decompose at the temperatures needed for adequate mixing of the blowing agent and spinning of the polymer.

Fluorocarbons which decompose, can discolor and degrade the polymer. Slight decomposition can be seen as a yellowing of the fiber while more severe decomposition can blacken it and cause deposits of degraded polymer in the spinning equipment. Also, in decomposing the fluorocarbon releases hydrochloric acid which corrodes the equipment.

One suitable stabilizer for FC-12 is di-2-ethylhexyl phosphite, which may also be used with F-114 under severe conditions. Nylon 6 can use F-12 without stabilizer because of its lower melting point. Polypropylene can employ FC-22 or FC-115. However, FC-114 and FC-115 are preferred because they are satisfactory with a wide variety of polymers at any reasonable processing conditions.

The ability to spin non-round filament cross sections is not adversely affected by the present process. Any small departures from the desired modification ratio of a trilobal filament, for example, caused by addition of blowing agent can be easily corrected by usual means such as adjusting the polymer viscosity, quenching conditions, etc. Therefore, filaments with large continuous voids of U.S. Pat. No. 3,745,061 may also have smaller random discontinuous voids of the present invention in the polymer.

Bubble initiation can also occur from "particle nucleation" which is sometimes combined with shear nucleation. When rough surfaced particles such as talc, titanium dioxide, nylon gels, degradation products, and metal salts are added to gas-laden polymer systems, the dissolved gas locates an area of the particle having surface voids sufficient to initiate bubble formation and the bubble expands with pressure reduction.

It has been found that the amount of shear which the polymer and dissolved blowing agent receive in a gear meter pump or equivalent device before entering the spinneret has an important effect on the number, size and uniformity of distribution of the voids. Such a pump has very close clearances between teeth of the meshed gears and between the side faces of the gears and the housing to minimize leakage of polymer from the high pressure to the low pressure side. Therefore, polymer which is within these clearances is highly sheared. It is believed that this polymer reaches very high instantaneous temperatures (probably more than 400° C.) which greatly reduces the polymer viscosity. It is also believed that as the gear teeth disengage, they produce an instantaneous vacuum near the roots of the teeth which permits bubbles to form. Although the bubbles probably collapse under the high pressure at the outlet of the pump, and the sheared material is only a small percentage of the total polymer passing through the pump, the transient bubble formation is believed to create "seeds" distributed through the polymer where bubbles can re-form readily when pressure is rapidly reduced at the spinneret (shear-nucleated voids).

The heat generated by the mechanical work in the pump raises the average temperature of the polymer since greater amounts of shear result in a greater adiabatic temperature rise.

Figure 7C:
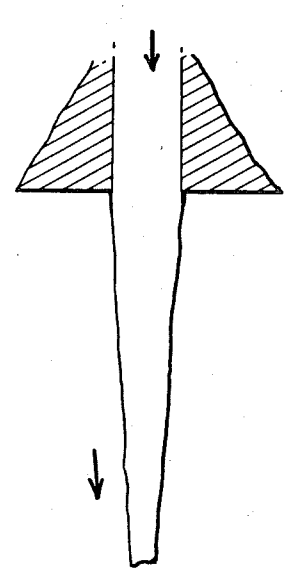
FIG. 7(*a*) is a schematic drawing of the shape of the polymer as it exits a conventional spinneret.
Figure 7B:
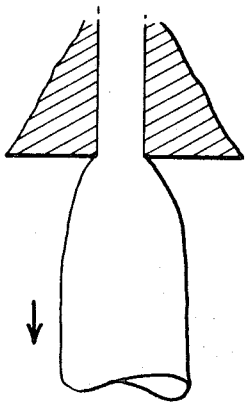
Figure 7A:
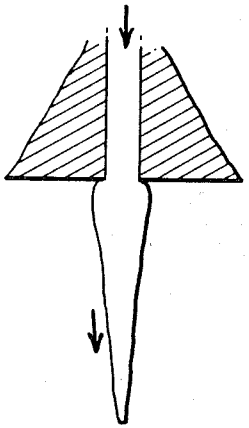

A distinct feature of the present invention is demonstrated by the polymer as it exits the spinneret. FIG. 7(*a*) shows that in a conventional melt spinning process, having small spinneret capillaries and a high polymer velocity the polymer forms a "carrot", where the polymer first expands in diameter immediately after exiting, then decreases in diameter as the polymer cools and is drawn away to form unoriented or partially-oriented filaments. FIG. 7(*b*) shows that in conventional foaming processes where low density products with large polyhedral cells are desired, the polymer expands continually to a final diameter several times larger than that of the capillary. In contrast, as can be seen in FIG. 7(*c*), the polymer of the present invention typically exits from the spinneret no larger than the dimensions of the exit due to low velocity of the polymer and substantial development of voids within the polymer internally of the spinneret, and then is reduced in diameter as the filament is oriented, in contrast to external expansion which is characteristic of conventional melt spinning processes.

Products of this invention have reduced density which usually results in lower cost per unit weight of fiber, and this advantage can be obtained while retaining higher physical properties than would be expected. Various degrees of luster and soil hiding may be obtained by controlling the number and size of the cells.

TEST METHODS

Cells per Fiber

Measurement of cell count is accomplished by making a standard black and white cross-section photograph of the yarn bundle (~68–80 filaments) using an optical microscope of 100–500× magnification. The cross-sectioned fibers are illuminated by transmitted incandescent light. The photo is examined visually and ten representative fibers are selected. Cells in each fiber are counted and the average number of cells in ten fibers determined. This number is reported as the "cells per fiber" for that yarn product.

Cell Length/Diameter Ratio

The cell length is measured by cutting yarn filaments to a length of 1½ inches, mounting the filaments on a standard glass slide, covering the filaments on the slide with Cargill Type "A" Immersion Oil, and covering the filaments and oil with a cover-glass. The slide is then placed on a conventional optical microscope with an incandescent transmitted light illuminator and the length of the filaments recorded at a magnification of 100×. The filaments are then observed at a magnification of 293× and the cell diameter recorded. The ratio of cell length to cell diameter is then calculated and reported as cell "L/D". A micron scale within the microscope optics is used to make the measurement.

Relative Viscosity

Nylon

For nylon the method for measuring relative viscosity is that set out in U.S. Pat. No. 4,301,102, column 10, lines 9–16:

> Relative viscosity (RV) for nylon is the ratio of the absolute viscosity of a solution of 8.4 weight percent nylon 66 or nylon 6 (dry weight basis) dissolved in formic acid solution (90% formic acid and 10% water) to the absolute viscosity of the formic acid solution, both absolute viscosities being measured at 25 ±0.1° C. Prior to weighing, the polymer samples are conditioned for two hours in air of 50% relative humidity.

Polyester

For polyester the relative viscosity is called LRV and is the ratio at 25° C. of the flow times in a capillary viscometer for solution and solvent. The solution is 4.75 weight percent of polymer in solvent. The solvent is hexafluoroisopropanol containing 100 ppm of $H_2SO_4$.

Polypropylene

Melt flow rate ("MFR") of polypropylene polymer is measured in accordance with ASTM D-1238L and is reported in grams per 10 minutes.

Thermal Stability of Fluorocarbons in Molten Nylon

The stability of fluorocarbon compounds in the presence of molten nylon is determined as follows:

Moisture is removed from the nylon beads at 120° C. under 26 inches of mercury vacuum for 4 hours. For each test, about 1.3 g. of the dry nylon resin and a steel-1010 coupon (2⅜"×¼"×1/16", 120-grit surface) are placed in a pre-cleaned and dry thermal shock resistant glass tube (7/16"×11"). The tube is mounted on a device which permits the evacuation of air from the tube and the later metering of 0.13 g. of air-free fluorocarbon into the tube. With the tube contents frozen with liquid nitrogen, the tube is sealed (7/16"×5½"). If the test involves use of a stabilizer, 0.0052 g. di-2-ethylhexyl phosphite is added at the same time as the nylon. The sample is then heated to a temperature representative of the conditions in a polymer spinning system and changes in the coloration of the nylon are recorded. The worst "acceptable" conditions are light yellow or cream color polymer and slight tarnish on the coupon. The worst acceptable limits are reached in the following times for the various fluorocarbons with nylon 66 and a copolymer of nylon 66 and 4% nylon 6 at 279° C.

| | Max. Acceptable Exposure Time(min) | |
|---|---|---|
| Fluorocarbon | Nylon 66 | Nylon 66/6 (4%) |
| None | 160 | 160 |
| 11 | 0.01 | 0.01 |
| 12 | 5 | 2 |
| 22 | 1 | 0.2 |
| 114 | 29 | 20 |
| None, plus phosphite | 170 | 190 |
| 11, plus phosphite | 0.1 | 0.1 |
| 12, plus phosphite | 20 | 17 |
| 22, plus phosphite | 4 | 5 |
| 114, plus phosphite | 23 | 28 |

The molten nylon and fluorocarbon are exposed to conditions similar to those above for approximately 15 minutes in the spinning equipment. Therefore only the combinations which exceed 15 minutes are acceptable. Fluorocarbon 115 would be more stable than 114 and would be acceptable under the above conditions.

Shear in Meter Pump

As used herein with regard to the gear pump operation, the shear rate applied to the fluid is defined as follows:

$$\text{Shear Rate} = \frac{\pi DN}{d}$$

Where:

D is the outer diameter of the gear d is the clearance between the gear teeth and the pump casing in the valve of d for the pump used in the Examples was 0.0003 in (0.00076 cm)

N is the rotational speed of the gear in revolutions per second

EXAMPLES

In Example 1 FC-114 is injected, as indicated in FIG. 3, at a rate of 1.04 g./min. into a pipe carrying a salt blend copolymer of 96% nylon 66 and 4% nylon 6 giving 0.19% FC-114 in the polymer. There are 14 Kenics mixers in the pipe after the injection point and a flow inverter as shown in FIG. 5 is installed after the first 7 Kenics mixers giving a well distributed mixture of polymer and FC-114. The FC-114 dissolves in the polymer at the pressure of 126.5 kg/cm$^2$ psig and a temperature of 287° C. The polymer then passes through a meter pump producing a shear rate of 13034 sec$^{-1}$, filter to remove foreign matter and gelled polymer then through a distributor plate described in Table I and into a spinneret as shown in FIG. 4. The meter pump is a two stream, 4.67 cc capacity, having 21 teeth gears, with clearance between teeth and housing of 0.0003 in. (0.000762 cm). As shown in Table I the spinneret has a larger diameter capillary than is typical for melt spun filaments, which is preceded by a significantly larger counterbore wherein the polymer resides at low pressure while the fluorocarbon comes out of solution and forms bubbles. The counterbore for all Examples and controls has a length of about 1.25 cm. The exit of this passage is in the form of three radial slots, giving filaments of trilobal shape. As the slowly advancing polymer emerges from the spinneret, filaments are drawn away at a drawdown ratio of 553. The filaments are solidified, cooled by crossflow quench air and are collected.

Control A is produced similarly to Example 1 except that no fluorocarbon is added, the spinneret capillary and counterbore as indicated in Table I are smaller and more nearly conventional, and consequently the shear rate in the spinneret is higher. The jet velocity of the polymer is therefore higher and the drawdown lower, but the denier of the filaments of both Example 1 and Control A after stretching between the spinneret and the first powered roller are approximately 40.6 denier and after cold drawing are approximately 14.4 denier. Example 1 has 15.5 cells per fiber while Control A has none.

Example 2 is produced similarly to Example 1 except that FC-114 is injected at a rate of 0.29 g/min into a pipe carrying nylon 66 polymer giving 0.041% fluorocarbon in the polymer. The meter pump has a shear rate of 14121 sec$^{-1}$. Shear in the distribution plate capillaries is 84.88 sec$^{-1}$. The spinneret has the dimensions shown in Table 1 and the exit has three radial slots giving filaments of trilobal shape. The shear rate is 209.8 sec$^{-1}$.

The filaments are drawn away at a draw-down ratio of 603.6 and are immediately drawn further 2.6× in a coupled process, crimped in a hot air jet bulking process and wound on a package as continuous filament yarn.

Control B is prepared similarly to Example 2 except that no fluorocarbon is injected. The trilobal spinneret has smaller dimensions giving a much higher shear rate and the drawdown is at a much lower ratio of 48.8. Example 2 has 8.2 cells per fiber while Control B has none.

In Example 3, FC-114 is injected at a rate of 3.2 g/min. into a pipe carrying polyethylene terephthalate at a pressure of 84.4 kg/cm$^2$ and a temperature of 287° C., giving 0.672% FC-114 in the polymer. The meter pump, distribution plate and spinneret are the same as Example 2. The spinneret has the dimensions shown in Table 1. The product is a continuous filament yarn having random curvilinear crimp and an average of 24 cells per fiber.

In Example 4, FC-114 is injected at a rate of 3.28 g/min. into polypropylene at a pressure of 109 kg/cm$^2$ and a temperature of 253° C., giving 0.661% FC-114 in the polymer. The distribution plate is the same as Examples 2 and 3 but the spinneret is somewhat larger, giving a lower shear rate. The product is a continuous filament yarn having a trilobal cross-section, random curvilinear crimp and an average of 8.1 cells per fiber.

Compared to Example 2, polypropylene requires considerably more blowing agent than nylon 66 to give the same number of cells.

In Example 5, FC-114 is injected at a rate of 0.22 g/min. into nylon 6 at a pressure of 109 kg/cm$^2$ and a temperature of 270° C., giving 0.035% FC-114 in polymer. The distribution plate and spinneret are the same as for Example 2 (nylon 66). The shear rates at each stage are somewhat higher than those of Example 2. The product is a continuous filament having random curvilinear crimp and an average of 13.1 cells per fiber.

In Example 6, FC-115 is used instead of FC-114, injected at a rate of 0.78 g/min. into nylon 66 at a pressure of 105.5 kg/cm$^2$ and a temperature of 285° C. giving 0.118% FC-115. The spinneret is slightly larger than Example 2, giving a slightly lower shear rate. The product has an average of 12.7 cells per fiber.

Example 7 uses FC-114 injected at a rate of 0.88 gms/min. into nylon 66 at a pressure of 105.5 kg/cm$^2$ a temperature of 285° C. giving 0.113% FC-114 in polymer. Other conditions are comparable to Example 6. However, this product has only 1 cell per fiber as a result of the combination of higher relative viscosity and using FC-114.

In Example 8 and Example 9, FC-114 is injected at a rate of 1.06 g/min. into nylon 66 at a pressure of 105.5 kg/cm$^2$ and a temperature of 285° C., giving 0.161% FC-114 in polymer. The only difference between the two is that Example 8 uses a distributor with small holes having high shear rate while Example 9 has a low-shear plate. The distributor used in the spinning pack for Example 8 is an inverted spinneret with the holes of the upper counterbores directly aligned with the holes of the lower counterbores except that the diameter of the upper counterbores is smaller than the diameter of the lower counterbores. Counterbore jet velocity, differential pressure and hold-up time are given for both upper and lower counterbores respectively in Table I. The filaments of Example 8 have 15 cells/fiber while those of Example 9 have 2.

The substantially gas-filled cell content of Examples 1–9 is greater than ½% by volume and less than 50% by volume.

The number of cells/fiber of Examples 7 and 9 are low due to the high relative viscosity and corresponding high melt viscosity. The number of cells/fiber of Example 6 is high, despite the high relative viscosity because FC-115 has a lower boiling point than FC-114 and thus has a higher vapor pressure than FC-114. The number of cells/fiber of Example 8 is high despite the high relative viscosity because a high shear distributor was used and its shear nucleates the bubbles and also lowers the melt viscosity in the distributor prior to entering the spinneret.

TABLE I

| | Example 1 | Control A | Example 2 | Control B | Example 3 | Example 4 | Example 5 | Example 6 | Example 7 | Example 8 | Example 9 |
|---|---|---|---|---|---|---|---|---|---|---|---|
| Polymer Type | Nylon 66/6 | Nylon 66/6 | 66 Nylon | 66 Nylon | Polyester | Polypropylene | 6 Nylon | 66 Nylon | 66 Nylon | 66 Nylon | 66 Nylon |
| Freon Type | FC-114 | None | FC-114 | None | FC-114 | FC-114 | FC-114 | FC-115 | FC-114 | FC-114 | FC-114 |
| Freon Rate (g/m) | 1.04 | 0 | 0.29 | 0 | 3.2 | 3.28 | 0.218 | 0.775 | 0.874 | 1.056 | 1.056 |
| Pump Shear Rate ($Sec^{-1}$) | 13034. | 13034. | 14121. | 14121. | 10277. | 10359. | 14798. | 14798. | 14798. | 14798. | 14798. |
| Distributor | | | | | | | | | | | |
| Capillary Dia. (cm) | 0.157 | 0.157 | 0.157 | 0.157 | 0.157 | 0.157 | 0.157 | 0.157 | 0.157 | 0.042 | 0.157 |
| Capillary Lgth. (cm) | 1.588 | 1.588 | 1.588 | 1.588 | 1.588 | 1.588 | 1.588 | 1.588 | 1.588 | 0.030 | 1.588 |
| Counterbore Dia. (cm) | — | — | — | — | — | — | — | — | — | 0.1778 | — |
| Jet Velocity (cm/min) | 92.54 | 92.54 | 100.25 | 100.25 | 61.64 | 72.96 | 73.55 | 105.07 | 105.07 | 2496.42 | 105.07 |
| Shear Rate ($Sec^{-1}$) | 78.33 | 78.33 | 84.88 | 84.88 | 52.19 | 61.78 | 62.27 | 88.96 | 88.96 | 19438. | 88.96 |
| Spinneret | | | | | | | | | | | |
| Capillary Diam. (cm) | 0.175 | 0.055 | 0.198 | 0.061 | 0.198 | 0.247 | 0.198 | 0.214 | 0.214 | 0.175 | 0.175 |
| Capillary Lgth. (cm) | 0.030 | 0.030 | 0.025 | 0.020 | 0.025 | 0.030 | 0.025 | 0.025 | 0.025 | 0.030 | 0.030 |
| Counterbore Diam. (cm) | 0.475 | 0.178 | 0.58166 | 0.1778 | 0.582 | 0.475 | 0.582 | 0.635 | 0.635 | 0.475 | 0.475 |
| Capillary Jet Velocity (cm/min) | 127.7 | 1292.5 | 108.07 | 1336.97 | 66.451 | 55.4 | 113.265 | 96.851 | 96.851 | 145.255 | 145.255 |
| Shear Rate ($Sec^{-1}$) | 204.2 | 6146.9 | 209.8 | 8339.2 | 128.9 | 61.5 | 215. | 170.8 | 170.8 | 228.2 | 228.2 |
| Melt Viscosity (poise) | 1000. | 360. | 1000. | 350. | — | — | — | 1050. | 1050. | 1000. | 1000. |
| Capillary Differential Pressure $kg/cm^2$ | 0.069 | 2.56 | 0.0381 | 1.39 | — | — | — | 0.030 | 0.030 | 0.079 | 0.079 |
| Counterbore Hold up Time, sec. | 4.22 | 0.59 | 5.86 | 0.46 | — | — | — | 6.66 | 6.66 | 0.68/3.72 | 3.72 |
| Counterbore Differential Pressure ($kg/cm^2$) | 0.07 | 3.42 | 0.062 | 4.055 | — | — | — | 0.048 | 0.048 | 3.576/0.176 | 0.176 |
| Counterbore Jet Velocity (cm/min.) | 17.3 | 123.4 | 12.5 | 157.3 | — | — | — | 11.0 | 11.0 | 123.4/19.6 | 19.6 |
| Draw-Down | 553 | 52.7 | 603.6 | 48.8 | 762.2 | 715.1 | 712.6 | 664.2 | 644.2 | 535.8 | 535.8 |
| Mechanical Draw Ratio | 3.0 | 3.0 | 2.6 | 2.6 | 2.9 | 2.7 | 2.3 | 2.8 | 2.8 | 2.2 | 2.2 |
| Total Extension | 1338 | 155.4 | 1568 | 127 | 2110 | 1931 | 1639 | 1840 | 1784 | 1179 | 1179 |
| Product Properties | | | | | | | | | | | |
| Relative Viscosity | 65. | 67. | 69.2 | 66.4 | 19.79 LRV | 35 MFR | 60.1 | 73.6 | 73.6 | 78.8 | 78.8 |
| Denier/Filament | 14.3 | 14.5 | 15.4 | 18.4 | 17.3 | 14.2 | 15.8 | 15.3 | 14.9 | 14.7 | 15.1 |
| Tenacity g/d | 4.18 | 4.16 | 3.08 | 3.1 | 1.24 | 2.2 | 2.25 | 2.83 | 3.09 | 2.32 | 2.47 |
| Elongation (%) | 56. | 73. | 45. | 51. | 34. | 137. | 36. | 43. | 45. | 52. | 57. |
| BCE/ABO | — | — | 52. | 47.5 | 40.2 | 30.3 | 28.1 | 36.7 | 38.6 | 60.9 | 52.9 |
| Cells/Fiber | 15.5 | 0 | 8.2 | 0 | 24. | 8.1 | 13.1 | 12.7 | 1. | 15. | 2. |
| *Filament Diameter ($\mu$) | 55.6 | 53.3 | 45.0 | 54.6 | 40.0 | 48.0 | 43.3 | 45.3 | 43.0 | 44.7 | 43.5 |
| Cell Diameter ($\mu$) - max. | 10.0 | — | 3.6 | — | 7.5 | 3.9 | 4.1 | 6.8 | 6.8 | 5.0 | 3.8 |
| Cell Diameter ($\mu$) - min. | 1.2 | — | 0.7 | — | 1.3 | 1.0 | 0.7 | 2.3 | 1.1 | 1.3 | 1.9 |
| Cell Diameter ($\mu$) - avg. | 3.8 | — | 2.5 | — | 3.2 | 3.0 | 2.0 | 4.5 | 3.6 | 2.5 | 2.8 |
| Avg. Cell Diameter/ Filament Diameter | 1/15 | — | 1/17 | — | 1/12 | 1/16 | 1/21 | 1/10 | 1/12 | 1/18 | 1/16 |
| *Adjusted | 1/11 | — | 1/13 | — | 1/9 | 1/12 | 1/16 | 1/8 | 1/9 | 1/14 | 1/12 |

*Trilobal filaments required adjustment of the ratio by a factor of 1/.75 to correct for actual diameter of an equivalent round filament. Filament diameter above is the circumscribed diameter of a trilobal filament.

What is claimed is:

1. A process for making a fiber with cells comprising the steps of:

(a) mixing a fluorocarbon blowing agent into molten polymer and shearing the molten polymer at greater than about 8,000 reciprocal seconds; thereafter (b) extruding the molten polymer through a spinneret capillary at a jet velocity of 5–150 cm/min. and a differential capillary pressure of less than 0.5 $kg/cm^2$ resulting in substantial development of voids within the polymer internally of the spinneret; and (c) drawing down the polymer extrudate at a total extension of greater than 1000.

2. The process of claim 1 wherein the amount of fluorocarbon blowing agent injected into the molten polymer 5 is less than 2%.

3. The process of claim 2 further comprising extruding the molten polymer through a counterbore at a jet velocity of 5–50 cm/min.

4. The process of claim 3 wherein the spinneret capillary has a differential pressure of less than 0.1 $kg/cm^2$.

5. The process of claim 2 wherein the molten polymer is polyamide.

6. The process of claim 5 wherein the fluorocarbon blowing agent is from the group comprising dichlorotetrafluoroethane, monochloropentafluoroethane and dichlordifluoromethane.

7. The process of claim 6 wherein the amount of fluorocarbon blowing agent injected into the molten polymer is less than 0.5%.

8. The process of claim 7 wherein the molten polymer temperature is less than 30° C. above the melting point of the polyamide polymer.

9. The process of claim 2 wherein the molten polymer is polyester.

10. The process of claim 9 wherein the molten polymer temperature is less than 30° C. above the melting point of the polyester polymer.

11. The process of claim 2 wherein the molten polymer is polypropylene.

12. The process of claim 11 wherein the molten polymer temperature is greater than 50° C. above the melting point of the polypropylene polymer.

13. The process of claim 1 wherein the shearing at greater than about 8,000 reciprocal seconds is generated by a pump.

14. The process of claim 2 wherein the thermal stability of the fluorocarbon is acceptable.

* * * * *

UNITED STATES PATENT OFFICE

CERTIFICATE OF CORRECTION

PATENT NO. : 4,728,472

DATED : March 1, 1988

INVENTOR(S) : William T. Windley

It is certified that error appears in the above-identified patent and that said Letters Patent are hereby corrected as shown below:

Claim 2, column 15, line 18: delete "5".

Claim 6, column 16, line 4: "dichlordifluoromethane" should be -- dichlorodifluoromethane --.

Signed and Sealed this

Second Day of August, 1988

*Attest:*

DONALD J. QUIGG

*Attesting Officer*

*Commissioner of Patents and Trademarks*